US006161829A

United States Patent [19]

Kusumi

[11] Patent Number: 6,161,829

[45] Date of Patent: Dec. 19, 2000

[54] METHOD AND APPARATUS FOR PAPER FEEDING CAPABLE OF HANDLING MULTIPLE PAPER CASSETTES

[75] Inventor: Tadashi Kusumi, Kawasaki, Japan

[73] Assignee: Ricoh Company, Ltd., Tokyo, Japan

[21] Appl. No.: 09/253,050

[22] Filed: Feb. 19, 1999

[30] Foreign Application Priority Data

Feb. 19, 1998 [JP] Japan ..... 10-037367
Apr. 9, 1998 [JP] Japan ..... 10-097123

[51] Int. Cl.[7] ..... B65H 3/44

[52] U.S. Cl. ..... 271/9.05; 271/9.13; 271/118

[58] Field of Search ..... 271/9.05, 9.01, 271/9.11, 9.13, 117, 118

[56] References Cited

U.S. PATENT DOCUMENTS

| | | | |
|---|---|---|---|
| 5,078,380 | 1/1992 | Kitazawa | 271/9.05 |
| 5,083,762 | 1/1992 | Yoshizuka et al. | 271/9.05 |
| 5,383,654 | 1/1995 | Iseda | 271/9.05 |
| 5,678,814 | 10/1997 | Yokoyama et al. | 271/9.05 |

OTHER PUBLICATIONS

Patent Abstracts of Japan, JP 06 183600, Jul. 5, 1994.
Patent Abstracts of Japan, JP 09 086680, Mar. 31, 1997.

*Primary Examiner*—John M. Jillions

*Attorney, Agent, or Firm*—Oblon, Spivak, McClelland, Maier & Neustadt, P.C.

[57] ABSTRACT

A paper feed apparatus which is capable of avoiding an erroneous transfer of recording sheets includes a plurality of selectable paper handling mechanisms and a controller. The paper handling mechanisms include a base plate storing recording sheets, an elevator moving the base plate, a first detector detecting whether an uppermost-positioned paper sheet of the recording sheets is positioned at a predetermined paper feed position, a feed roller rotating in a paper feed direction, a separation roller in contact with the feed roller with a reverse driving force, a pick-up roller transferring an uppermost-positioned sheet to a nip portion between the feed and separation rollers, a pushing member pushing the separation roller to contact the feed roller, and a release member releasing the separation roller from contact with the feed roller. The controller controls the elevator of a selected paper handling mechanism to move the recording sheets stacked thereon so that an uppermost-positioned paper sheet of recording sheets is at the predetermined paper feed position using the first detector, and controls each elevator other than the elevator of the selected paper handling mechanism to move recording sheets stacked thereon so that an uppermost-positioned paper sheet of the recording sheets is away from the predetermined paper feed position using the first detector.

15 Claims, 4 Drawing Sheets

METHOD AND APPARATUS FOR PAPER FEEDING CAPABLE OF HANDLING MULTIPLE PAPER CASSETTES

BACKGROUND OF THE INVENTION

1. Field of the Invention

The present invention relates to a method and apparatus for paper feeding, and more particularly to a method and apparatus for paper feeding that is capable of handling multiple paper cassettes.

2. Discussion of the Background

Sheet separation has been an important function for a paper feed apparatus used in image forming apparatuses such as copying machines, printers, facsimile machines, and so forth. A sheet separation mechanism that separates a sheet from multiple sheets with a forward feed roller pair (feed roller) for sending a recording sheet forward and a reverse feed roller (separation roller) for reversing extra-transferred sheets using a torque limiter is particularly referred to as a forward/reverse roller system.

For example, in an image forming apparatus with a paper feed apparatus which adopts the forward/reverse roller system, stacks of recording sheets in a paper cassette or the like are sent by a pick-up roller sheet by sheet from an uppermost-positioned sheet of the stacks to a nip portion between the feed and separation rollers. At this time, one or more additional recording sheets may be erroneously transferred together with the uppermost-positioned sheet. This occurrence is referred to as a multiple sheet feed error.

At such a multiple sheet feed error, the paper feed apparatus based on the forward/reverse roller system is configured to separate the uppermost-positioned sheet from the additional recording sheets and to transfer only the uppermost-positioned sheet to an image forming section of the image forming apparatus. That is, the separation roller is configured to be kept in contact with the feed roller under pressure and is provided with a rotative force in a reverse direction relative to a transfer direction of the recording sheet. The separation roller may rotate in the reverse direction with a torque of at least 1 to 1.5 kgf-cm (kilogram force centimeter) via a torque limiter.

On the other hand, an image forming apparatus which includes a plurality of paper cassettes, sheet trays, or the like, has been provided in recent years in order to cope with increasing demand for being able to utilize various recording sheets of different sizes and kinds. In a paper feed apparatus of such an image forming apparatus, a plurality of paper feed mechanisms are provided so that the recording sheets in each paper cassette can be handled individually. Each paper feed mechanism of the paper feed apparatus generally includes a sheet elevation mechanism for lifting the stacks of recording sheets upwards to a predetermined paper feed position. For example, Japanese Laid-Open Patent Publication JPAP9-086680(1997) describes a sheet elevation mechanism. This mechanism is installed in each paper feed mechanism and lifts up a respective stack of recording sheets by causing a base plate in a paper cassette to pivot about a support shaft of the base plate.

Also, the above-described sheet separation mechanism included in each paper feed mechanism of the paper feed apparatus is generally configured to share a drive motor with all of the other sheet separation mechanisms from a cost reduction standpoint. Accordingly, the drive motor needs to bear a heavy load and, therefore, a reduction of a load required by each sheet separation mechanism becomes crucially important. In this aspect, the forward/reverse roller system generally reduces loads of the sheet separation mechanisms by disengaging the feed roller from the separation roller at the sheet separation mechanisms of the paper feed mechanisms which are in an inoperative mode. This technique is described in Japanese Laid-Open Patent Publication No. JPAP6-183600.

However, this technique has a problem in that the feed rollers of the sheet separation mechanisms of the paper feed mechanisms which are in an inoperative mode become free from contact with their respective separation rollers and tend to start to rotate by themselves due to a frictional rotation of a clutch mechanism. As a result, a recording sheet may be transferred forward by the rotating feed roller if the recording sheet is positioned near the feed roller. That is, the sheet separation mechanisms of the paper feed mechanisms which are in an inoperative mode may transfer recording sheets, which may cause a paper jam in the image forming section of the image forming apparatus.

The above-described problem may be avoided by adding ball bearings inside the clutch, coating a sliding surface inside the clutch with a relatively low-friction substance, or the like. However, these countermeasures increase a machine cost.

SUMMARY OF THE INVENTION

Accordingly, an object of the present invention is to provide a novel paper feed apparatus which is capable of avoiding an erroneous transfer of a recording sheet from inoperative paper feed mechanisms.

To achieve this and other objects, a novel paper feed apparatus of the present invention includes a plurality of selectable paper handling mechanisms and a controller. Each paper handling mechanism includes a base plate on which recording sheets are stored, an elevator which moves the base plate up and down, and a first detector which detects whether an uppermost-positioned paper sheet of the recording sheets is positioned at a predetermined paper feed position. Further, each paper handling mechanism includes a feed roller which is driven to rotate in a paper feed direction. Further, each paper handling mechanism includes a separation roller which is in contact with the feed roller under pressure and which is provided with a driving force in a reverse direction relative to a paper feed direction via a torque limiter. Further, each paper handling mechanism includes a pick-up roller which transfers an uppermost-positioned sheet from the recording sheets stored on the base plate to a nip portion which is formed between the feed roller and the separation roller. Further, each paper handling mechanism includes a pushing member which pushes the separation roller to make the separation roller contact the feed roller under pressure when an uppermost-positioned recording sheet is being transferred and a release member which releases the separation roller from a condition in which the separation roller is in contact with the feed roller under pressure when no uppermost-positioned recording sheet is being transferred.

The controller controls the elevator of a selected paper handling mechanism from among the plurality of paper handling mechanisms to move a stack of recording sheets so that an uppermost-positioned paper sheet of the stack of recording sheets is positioned at the predetermined paper feed position based on a result of detection of the first detector. Further, the controller controls each elevator other than the elevator of the selected paper handling mechanism to move stacks of recording sheets so that a respective uppermost-positioned paper sheet of the stacks of recording sheets is away from the predetermined paper feed position based on a result of detection of the first detector.

Each of the plurality of paper handling mechanisms may further include a second detector which is mounted downstream from the feed roller and the separation roller and which detects whether transfer of all the recording sheets has been completed. The controller may stop operations of the selected paper handling mechanism upon determining that a last recording sheet in a copy job which is charged to the selected paper handling mechanism has been transferred by the selected paper handling mechanism based on a result of detection of the second detector of the selected paper handling mechanism.

The controller may control each elevator other than the elevator of the selected paper handling mechanism to move the stacks of recording sheets so that respective uppermost-positioned paper sheets of the stacks of recording sheets are positioned at predetermined paper feed positions during a time period from a time that the selected paper handling mechanism completes a transfer of a last recording sheet in the copy job until a time that the last recording sheet is ejected.

The controller may sequentially control elevators other than the elevator of the selected paper handling mechanism to move respective stacks of recording sheets with a predetermined time delay from a movement of a previous elevator.

The paper handling mechanism may further include a third detector which detects whether the base plate is positioned at a predetermined lowermost position, and the controller may control each elevator other than the elevator of the selected paper handling mechanism to lower the same down to predetermined lowermost positions based on a result of detection of the third detector.

Another object of the present invention is to provide a method of manufacturing a recyclable toner-carrying roller at a relatively low cost.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
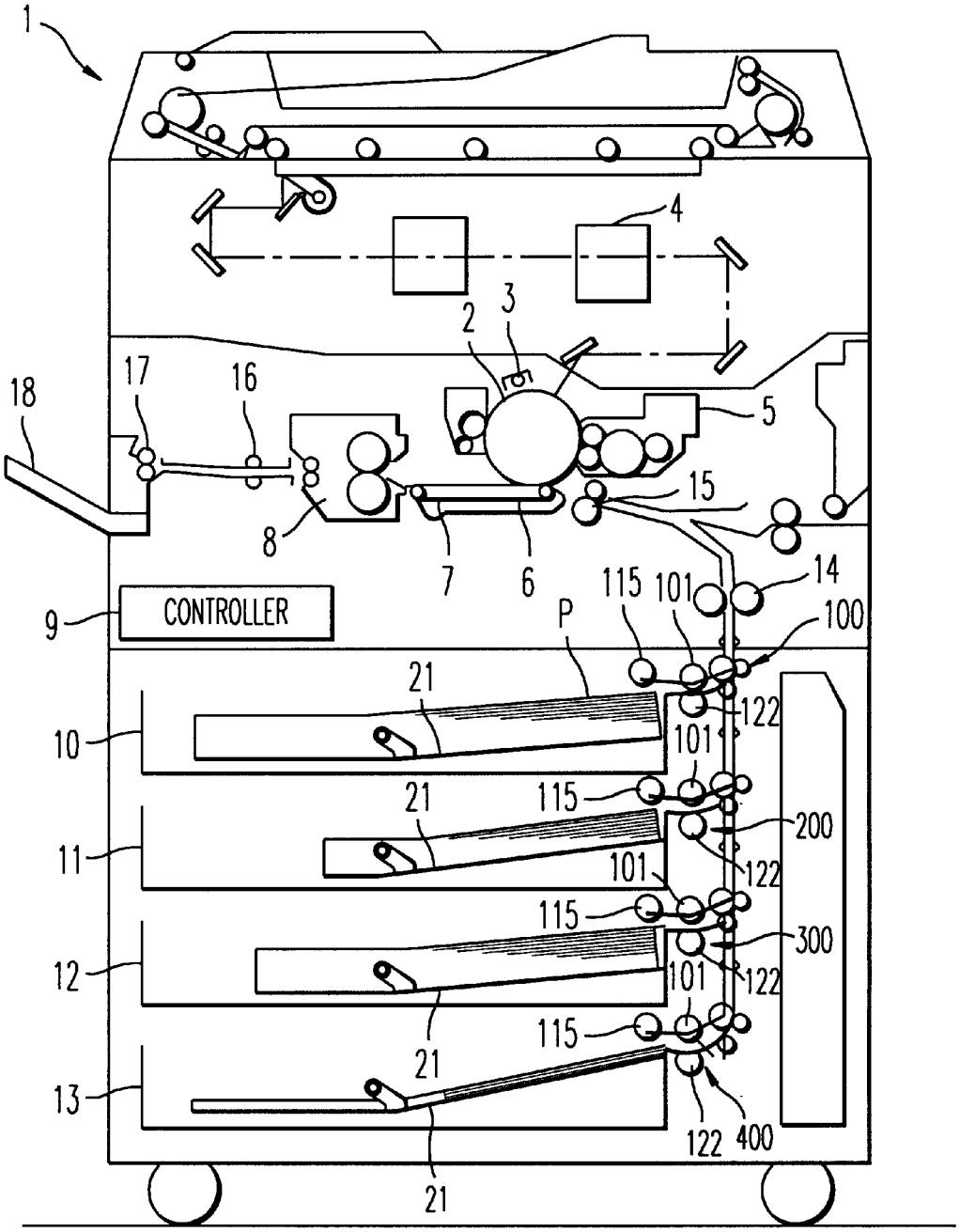
FIG. 1 is a schematic diagram for explaining an image forming apparatus according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, an electrophotographic copying machine 1 is illustrated as an example of an image forming apparatus according to an embodiment of the present invention.

The copying machine 1 of FIG. 1 includes an electrophotographic image forming mechanism that includes a photoconductor 2, a charger 3, an optical system 4, a development unit 5, an image transfer unit 6, a sheet conveying belt 7, and an image fixing unit 8. The copying machine 1 further includes a recording sheet handling mechanism that includes paper cassettes 10–13, an intermediate roller 14, a registration roller 15, eject rollers 16 and 17, and an eject tray 18.

Each of the paper cassettes 10–13 includes a bottom plate 21 to hold thereon recording sheets P. The recording sheet handling mechanism of the copying machine 1 further includes paper feed units 100–400, which are mounted on the paper cassettes 10–13, respectively. Each of the paper feed units 100–400 has several important mechanisms, including a sheet separation mechanism and a sheet elevation mechanism. The sheet separation mechanism of each of the paper feed units 100–400 includes a feed roller 101, a pick-up roller 115, and a separation roller 122. The sheet elevation mechanism of each of the paper feed units 100–400 is explained in further detail below.

In the electrophotographic image forming mechanism of the copying machine 1 of FIG. 1, the photoconductor 2 rotates clockwise and has a surface which evenly receives a positive or negative charge from the charger 3. The photoconductor 2 receives on its charged surface rays of light which are reflected from an original document (not shown) and which are guided by the optical system 4. The charge on the surface of the photoconductor 2 is varied in accordance with the image of the original document by the rays of light. Thereby, an electrostatic latent image is formed on the photoconductor 2 in accordance with the image of the original document. The photoconductor 2 then attracts toner particles which are supplied from the development unit 5 so as to visualize the electrostatic latent image with the toner particles. A toner image is thus formed on the photoconductor 2.

In the recording sheet handling mechanism of the copying machine 1 of FIG. 1, each pick-up roller 115 operates to pick up and slide a top sheet of the recording sheets P towards the aforementioned sheet separation mechanism formed with the feed roller 101 and the separation roller 122 included in each of the paper feed units 100–400. At this time, a plurality of upper sheets may accidentally slide towards the sheet separation mechanism together with the top sheet by friction between the sheets. This occurrence is referred to as a multiple-sheet feed. When the multiple-sheet feed occurs, the sheet separation roller 122 separates the top sheet from the upper sheets and advances only the top sheet.

The thus-advanced top sheet enters into a paper path which is provided inside the copying machine 1 and which is commonly used by the recording sheets P transferred from each of the paper feed units 100–400. The top sheet passes through the intermediate roller 14 and is stopped by the registration roller 15. The registration roller 15 starts to transfer the top sheet to the sheet conveying belt 7 with the timing of a commencement of an image transfer operation and in synchronism with the rotation of the photoconductor 2. Through the image transfer operation, the toner image on the photoconductor 2 is transferred onto the top sheet. Then, the top sheet having the toner image thereon is forwarded to the image fixing unit 8 that performs an image fixing operation in which the toner image is fixed on the surface of the top sheet. After the image fixing operation by the image fixing unit 8, the top sheet is transferred to the eject tray 18 by the eject rollers 16 and 17.

Next, an exemplary structure of the sheet elevation mechanism that elevates the sheets in each paper cassette 10–13 is explained with reference to FIG. 2. As mentioned above, each of the paper feed units 100–400 includes the sheet elevation mechanism. Since each paper feed unit 100–400, including their sheet elevation mechanisms, is structured in a manner similar to each other, the following description describes the sheet elevation mechanism of the paper feed unit 100 and the redundant descriptions for the paper feed units 200–400 are omitted.

Figure 2:
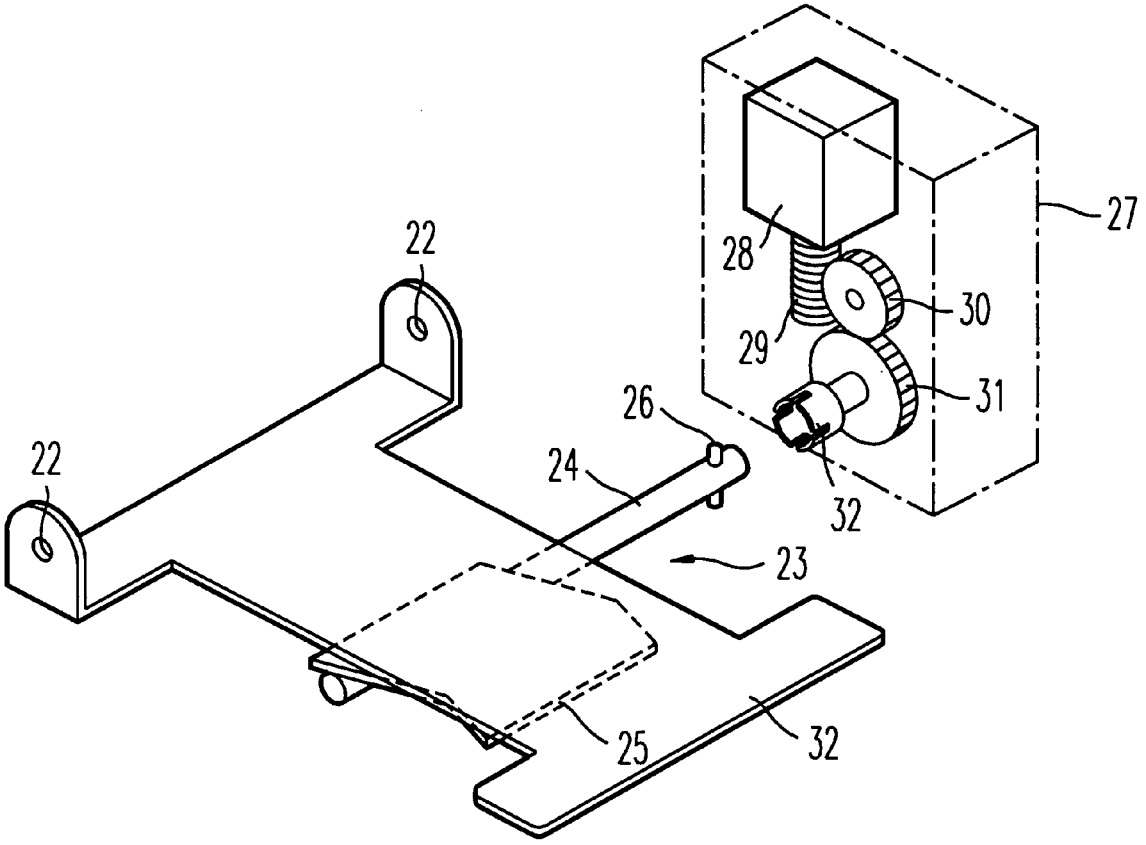
FIG. 2 is an illustration for explaining a sheet elevation mechanism of the image forming apparatus of FIG. 1.

As illustrated in FIG. 2, the bottom plate 21 of the paper cassette 10 is movably held by a first shaft (not shown) on shaft holes 22 of the paper cassette 10. Pivoting about the first shaft, the bottom plate 21 moves the recording sheets P placed thereon such that leading edge sides of the recording sheets P relative to the direction of a sheet flow are raised up and down. Mounted on the bottom of the bottom plate 21 is an elevating member 23 which includes a second shaft 24, an eccentric-rotation plate 25, and two pins 26.

As illustrated in FIG. 2, the pivot plate 25 is secured on the second shaft 24 at a place near one edge thereof, and the pins 26 are secured at a place near the other edge thereof. The pins 26 are arranged to protrude from the surface of the second shaft 24. When the second shaft 24 is rotated around its axis, the pivot plate 25 is caused to pivot about the rotation axis of the second shaft 24 so as to push the bottom plate 21 upwards. Consequently, the bottom plate 21 is raised upwards in the way as described above.

Reference numeral 27 of FIG. 2 denotes a sheet-elevation driving unit which is included in the sheet elevation mechanism. The sheet-elevation driving unit 27 includes an elevation motor 28, a worm gear 29, a wheel gear 30, a spur gear 31, and a coupling 32. The worm gear 29 is secured on a driving shaft of the elevation motor 28. The worm gear 29 is engaged with the wheel gear 30 which meshes with the spur gear 31. The coupling 32 is secured on a rotating shaft of the spur gear 31, and has a cylindrical-shaped end to which four slits are provided in a direction parallel to the rotating shaft of the spur gear 31. The pins 26 of the second shaft 24 are engaged in the slits of the coupling 32 so that the sheet-elevation driving unit 27 transmits the rotary force to the second shaft 24.

The thus-structured sheet elevation mechanism operates in the following manner. An installation of the paper cassette 10 at an operating position on the copying machine 1 is detected by a first sensor (not shown). Then, the detection causes a positive voltage output applicable to the elevation motor 28, so that the elevation motor 28 starts in the forward rotation direction. The elevation motor 28 drives the second shaft 24 of the elevating member 23 in the forward rotation direction. Consequently, the pivot plate 25 is caused to pivot about the rotation axis of the second shaft 24 to thus push the bottom plate 21 upwards. The bottom plate 21 then pivots about the first shaft (not shown) held in shaft holes 22, and the leading edge side of the bottom plate 21 relative to the direction of the sheet flow is raised upwards. Accordingly, when the recording sheets P are placed on the bottom plate 21, these sheets are caused to raise upwards.

Such an elevation of the bottom plate 21 is detected by a second sensor (not shown), or a bottom plate detect sensor, which is provided in the copying machine 1. The copying machine 1 determines if the bottom plate 21 is lifted to a predetermined height based on the detection of the second sensor. If the bottom plate 21 is not lifted to the predetermined height, the copying machine 1 arranges to continue the application of the positive voltage output from the elevation motor 28 to continue to drive, so that the bottom plate 21 continues to raise upwards. When the bottom plate 21 reaches the predetermined height, the copying machine 1 stops the application of the positive voltage output to the elevation motor 28 to stop the driving of the elevation motor 28.

In this way, the bottom plate 21 is elevated to the predetermined height. Accordingly, at the predetermined height, the top sheet of the recording sheets P on the bottom plate 21 is placed in a preferable position from which the top sheet can properly be transferred to a nip portion formed between the feed roller 101 and the separation roller 122. The above-described operation of the sheet elevation mechanism is controlled by a controller 9, e.g. a microcomputer, which controls the entire operation of the copying machine 1. When the bottom plate 21 has no recording sheet P, a third sensor 33 (FIG. 4), or a paper-out sensor, which is arranged relative to the paper cassette 10, detects that as a paper-out error. Then, the copying machine 1 arranges to drive the elevation motor 28 in the reverse direction so that the bottom plate 21 is lowered down to an initial position.

Next, an exemplary structure of the sheet separation mechanism that separates the top sheet from the upper sheets which are fed together is explained with reference to FIG. 3. As mentioned above, each of the paper feed units 100–400 includes the sheet separation mechanism. Therefore, as in describing the sheet elevation mechanism, the following description describes the sheet elevation mechanism of the paper feed unit 100 and the redundant descriptions for the paper feed units 200–400 are omitted.

Figure 3:
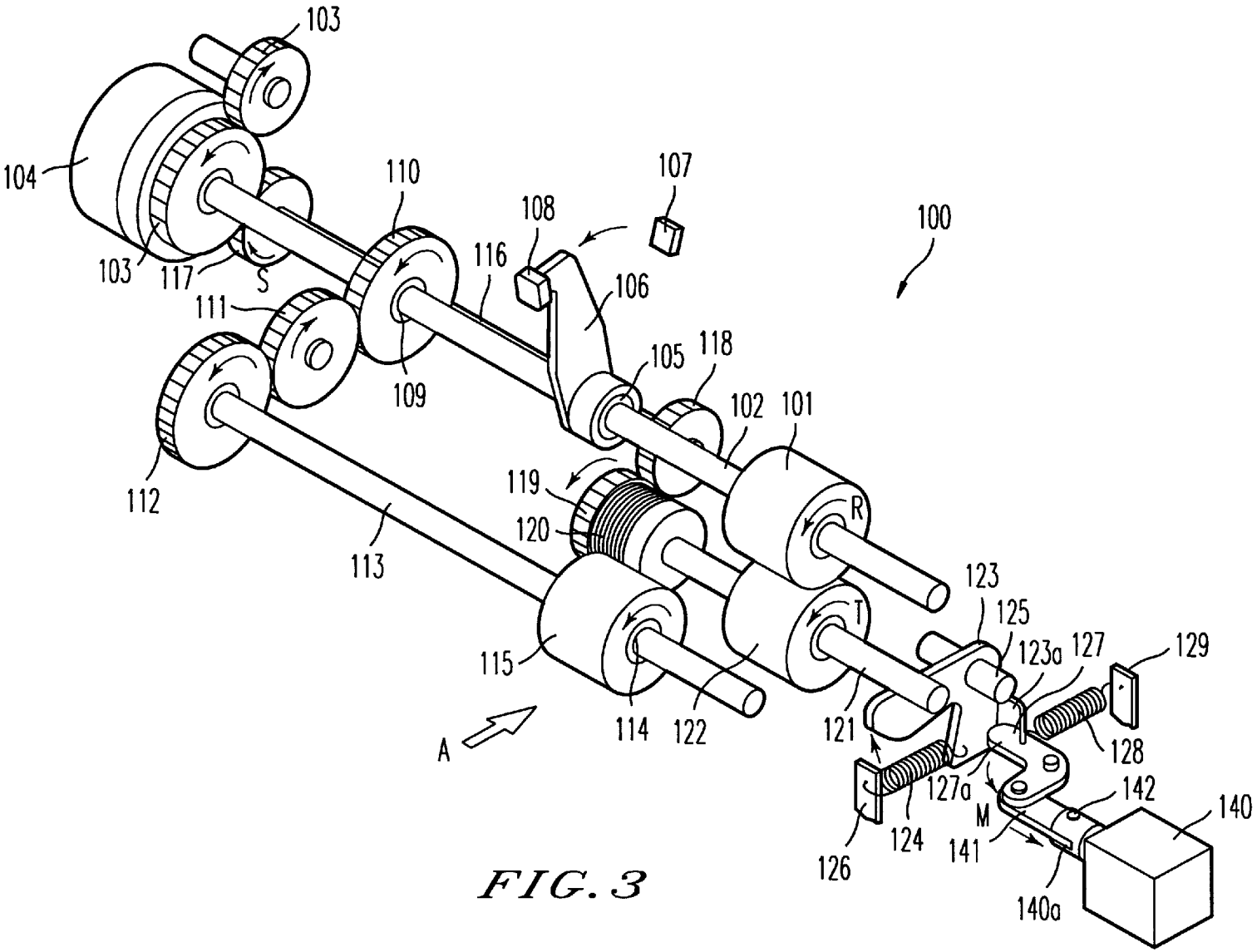
FIG. 3 is an illustration for explaining a sheet separation mechanism of the image forming apparatus of FIG. 1.

In the paper feed unit 100 of FIG. 3, a drive gear 130 which is rotated in the direction of an arrow L by a common motor (not shown) is engaged with a drive gear 103 which is mounted on one end of a feed roller shaft 102 that has the aforementioned feed roller 101 on the other end thereof. The feed roller shaft 102 also has an electromagnetic clutch 104, at a position next to the drive gear 103, for controlling the engagement of the drive gear 103 with the feed roller shaft 102. When the electromagnetic clutch 104 is turned to an engagement condition, the drive gear 103 is engaged with the feed roller shaft 102. Consequently, the feed roller shaft 102 rotates in the direction of an arrow R, and transmits its rotation to the feed roller 101.

The feed roller shaft 102 also has a one-way clutch 105, at a position relatively closer to the feed roller 101, on which a regulation arm 106 is provided. The one-way clutch 105 is engaged with the feed roller shaft 102 only when the feed roller shaft 102 rotates in the reverse direction. When the one-way clutch 105 is engaged with the feed roller shaft 102, the regulation arm 106 is rotated. However, two stopping members 107 and 108 are provided, as illustrated in FIG. 3, so as to regulate a range of rotation of the regulation arm 106.

The feed roller shaft 102 also has another one-way clutch 109, at a position relatively closer to the drive gear 103, on which a gear 110 is provided. The one-way clutch 109 is engaged with the feed roller shaft 102 when the feed roller shaft 102 rotates in the forward direction and is disengaged from the feed roller shaft 102 when the feed roller shaft 102 rotates in the reverse direction. Accordingly, the gear 110 rotates in the forward direction when the feed roller shaft 102 rotates in the forward direction and does not rotate in the reverse direction even when the feed roller shaft 102 rotates in the reverse direction. The gear 110 is engaged with a gear 112 of a pick-up roller shaft 113 via an idle gear 111, and thus the rotation of the gear 110 is transmitted to the pick-up roller shaft 113.

On the pick-up roller shaft 113, the aforementioned pick-up roller 115 is mounted, via a one-way clutch 114, at a position relatively distant from the gear 112. The one-way clutch 114 is engaged with the pick-up roller shaft 113 only when the pick-up roller shaft 113 rotates in the forward direction. Accordingly, the pick-up roller 115 rotates only in the forward direction by the rotation of the pick-up roller shaft 113. In this way, both the feed roller 101 and the pick-up roller 115 rotate in the direction R when the electromagnetic clutch 104 is engaged. By this rotation in the direction R, the recording sheet P is transferred in a direction indicated by an arrow A.

On the other hand, a gear 117 which is mounted on one end side of a torque-limit drive shaft 116 is engaged with the above-described gear 103 and is rotated in the direction of an arrow S. Another gear 118 which is mounted on the other end side of the torque-limit drive shaft 116 is engaged with a drive gear 119 of a torque limiter 120. The torque limiter 120 has a driven shaft 121 on which the aforementioned separation roller 122 is secured. The driven shaft 121 is pushed upwards by a pushing member 123, so that the separation roller 122 makes contact with the feed roller 101 under pressure. That is, the separation roller 122 is provided with a specific torque in the direction of an arrow T at a rotation of the drive gear 130, regardless of the engagement conditions of the electromagnetic clutch 104. The direction T is reverse relative to the paper feed direction A.

The pushing member 123, which has an L-shaped form, is rotatably supported by a shaft 125 and is hooked on one end thereof with a spring 124. One end of the spring 124 is fixed on a fixing plate 126 and, therefore, the spring 124 acts to have the pushing member 123 push the driven shaft 121 upwards.

The pushing member 123 has an extension part 123*a* on the same side of the L-shaped form where the spring 124 is hooked. A release member 127 having an L-shaped form is rotatably held by a shaft 142 near the extension part 123*a*, and is hooked on one end thereof with a spring 128 of which one end is fixed on a fixing plate 129. The other end of the release member 127 where the spring 129 is not hooked is connected to an actuator 140*a* of a release solenoid 140 via an auxiliary arm 141. When the release solenoid 140 is activated, the actuator 140*a* is pulled inside and the release member 127 is caused to pivot about a shaft 142 in the direction of an arrow M. Accordingly, the release member 127 is disengaged from the pushing member 123. In this way, the pushing member 123 pushes the driven shaft 121 upwards when the release solenoid 140 is in an activated mode.

Figure 4:
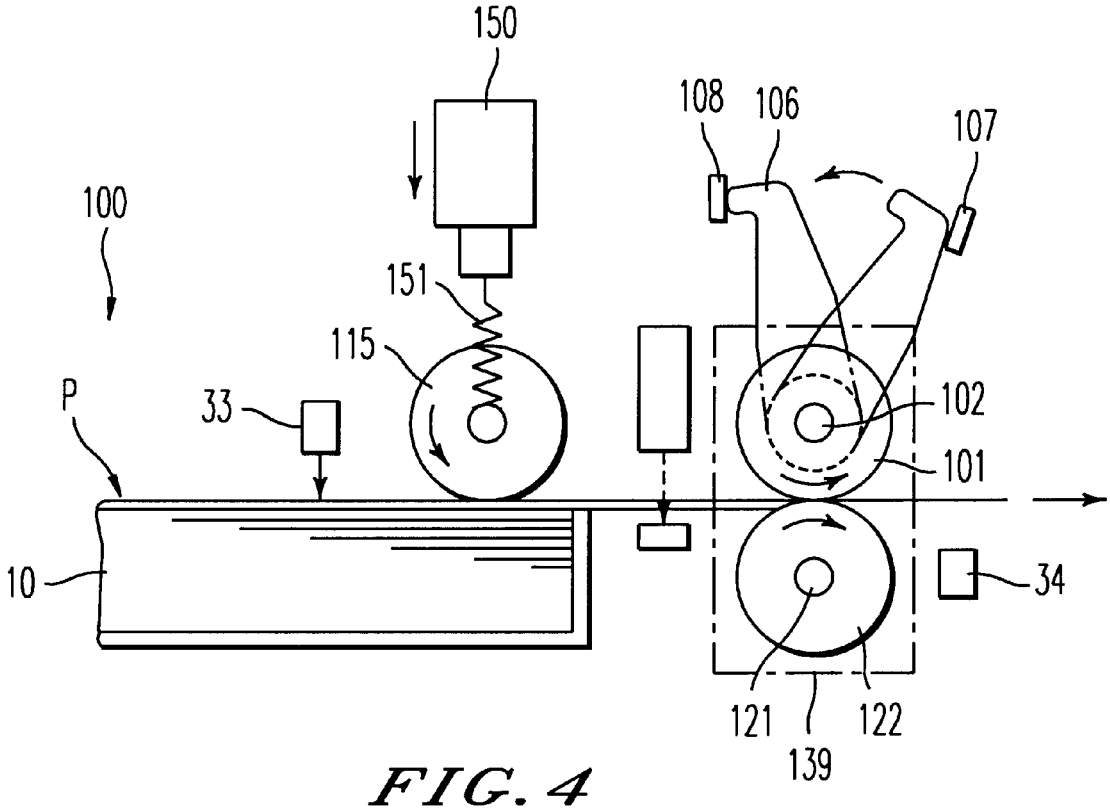
FIG. 4 is an illustration for explaining an operation of the sheet separation mechanism of FIG. 3.

As illustrated in FIG. 4, the pick-up roller 115 is supported by a solenoid 150 via a spring 151. When the solenoid 150 is in an inactivated mode, the pick-up roller 115 is moved down and makes contact under soft pressure with an uppermost-positioned sheet of the recording sheets P which are placed on the bottom plate 21 inside the paper cassette 10. The pick-up roller 115 is disengaged from the recording sheets in an activated mode of the solenoid 150.

When the release solenoid 140 is in an inactivated mode, the actuator 140*a* is discharged by the action of the spring 128 and the release member 127 is pivoted about the shaft 142 in the reverse direction relative to the direction M. Accordingly, a portion 127*a* of the release member 127 pushes the extension part 123*a* of the pushing member 123. Then, the pushing member 123 is caused to pivot about the shaft 125 so as to release the driven shaft 121 of the torque limiter 120 from the upward pressure. The separation roller 122 is then disengaged from the feed roller 101. As a result, the separation roller 122 rotates in the direction T without causing the torque limiter 120 to generate the torque.

The thus-structured sheet separation mechanism operates in the following manner. At an installation of the paper cassette 10 having the recording sheets P, the paper cassette 10 is detected and the bottom plate 21 is raised upwards by the action of the above-described sheet elevation mechanism so that the uppermost-positioned sheet of the recording sheets P is lifted up to a predetermined sheet supply position. Then, the pick-up roller 115 is moved down, by putting the solenoid 150 into an inactivated mode, to make contact under soft pressure with the uppermost-positioned sheet. At this time, the uppermost-positioned sheet can be transferred by the pick-up roller 115. Also, at this time, the paper-out sensor 33 of FIG. 4 is turned on and the recording sheets P are accordingly detected based on an output signal from the paper-out sensor 33.

Following the paper cassette 10, the paper cassettes 11–13 are installed in their respective positions in a similar manner on the copying machine 1. The operator selects one of the paper cassettes 10–13, which contains a desired sheet, using sheet selection keys (not shown) provided on a console panel (not shown) of the copying machine 1. The operator selects the paper cassette 10, for example. Then, upon pressing a copy start button (not shown), the release solenoid 140 (FIG. 3) of the paper feed unit 100 is turned to an activated mode and the pushing member 123 pushes the driven shaft 121 upwards. Accordingly, in the paper cassette 10 the separation roller 122 is made to contact the feed roller 101 under pressure so that the feed roller 101 can transfer the recording sheet.

After that, the electromagnetic clutch 104 is turned to an activated mode and the rotation of the drive gear 130 is transmitted to the feed roller 101. Accordingly, the feed roller 101 is rotated in the direction R. At the same time, since the rotation of the drive gear 130 is also transmitted to the pick-up roller 115, the pick-up roller 115 is rotated in the direction R. Further, since the rotation of the drive gear 130 is also transmitted to the torque-limit drive shaft 116, the separation roller 122 is given the torque which is in the reverse direction relative to the sheet transfer direction A.

Then, in the paper cassette 10 the uppermost-positioned sheet is started to be transferred, as illustrated in FIG. 4. At this time, if a plurality of the recording sheets, including the uppermost-positioned sheet, are conveyed to a sheet separation portion 139 (the sheet separation mechanism), i.e. if a multiple sheet feed arises, the recording sheets other than the uppermost-positioned sheet are rejected by the separation action of the separation roller 122. As a result, only the uppermost-positioned sheet is transferred forward.

In this way, the paper feed unit 100 of the selected paper cassette 10 operates in the manner as described above. At this time, the other paper feed units 200–400 of the paper cassettes 11–13 which are not selected are in an inactivated mode. That is, the separation rollers 122 of these other respective paper feed units 200–400 are each in a pressure release mode in which the separation rollers 122 are disengaged from the feed rollers 101. This arrangement makes it possible to avoid wasting electric power by the unselected paper feed units and to decrease the load to these unselected paper feed units. In this connection, the above-described arrangement may decrease deterioration of the torque limiter 120. FIG. 1 illustrates a case in which the separation roller 122 is discharged from the feed roller 101 in each of the unselected paper feed units 200–400 while the feed roller 101 is engaged with the separation roller 122 in the selected paper feed unit 100.

The above-described operations are basic operations of the copying machine 1. In addition to these basic operations, the copying machine 1 according to the present invention can move the bottom plate 21 of each of the unselected paper cassettes downward. More specifically, when the operator selects the paper cassette 10, for example, out of the paper cassettes 10–13 in order to select a desired sheet size or kind, or presses the copy start button, the elevation motors 28 of the paper feed units 200–400 of the unselected paper cassettes 11–13 are driven in the reverse direction for a certain time period. Accordingly, the bottom plates 21 of the unselected paper feed units 200–400 are moved down. Such an operation is controlled by the controller 9. In this case, a sufficient amount of downward movement by the bottom plate 21 is needed to separate the recording sheets P from the predetermined sheet feed position, away from the feed roller 101, and is preferably 5 mm or more.

FIG. 1 illustrates a case in which the bottom plates 21 of the unselected paper feed units 200–400 are moved downward so that the recording sheets P are away from the predetermined sheet feed position by more than, e.g., 5 mm while the bottom plate 21 of the selected paper feed unit 100 is held at the predetermined sheet feed position. Accordingly, even if any of the unselected paper feed units 200–400 has an uppermost-positioned recording sheet which is protruded by a previous paper feed operation, such a protruded uppermost-positioned recording sheet is not in a position to contact a respective feed roller 101. Thereby, the protruded uppermost-positioned recording sheet of the unselected paper feed units will not be erroneously transferred by its respective feed roller 101. As a result, an occurrence of a paper jam at the side of the electrophotographic image forming mechanism may be avoided.

Next, a return operation of the bottom plate from the above-described downward movement is explained. In the example of FIG. 1, the sheet feed operation by the paper feed unit 100 is finished when the selected paper feed unit 100 completes the transfer of the last recording sheet in a copy job. At the same time, the elevation motors 28 of the unselected paper feed units 200–400 are driven in the forward direction to raise the bottom plates 21 upwards so as to lift up uppermost-positioned sheets to the predetermined sheet feed positions.

When the last recording sheet in a copy job is transferred from the selected paper feed unit 100, a completion of such a last recording sheet is detected by a fourth sensor 34 (FIG. 4). Based on such a detection by the fourth sensor 34, the controller 9 calculates a transfer time and determines the timing to finish the sheet feed operation of the paper feed unit 100.

The return operation of the bottom plates 21 of the unselected paper feed units 200–400 is performed in parallel to the above-described operation of finishing the sheet feed operation of the paper feed unit 100. Further, such a return operation should be completed by the time that the last recording sheet transferred through the paper feed unit 100 is ejected to the eject tray 18 (FIG. 1). In order to complete the return operation in such a manner, the rotation speed of the elevation motor 28 and/or the downward movement amount of the bottom plate 21 are controlled.

The above returns of the bottom plates 21 of the unselected paper feed units 200–400 can be controlled to have a relatively small shift in time from one to another by adjusting the drive timing of each elevation motor 28 in the forward direction. An order of starting the elevation motors 28 may be freely determined, and the shift in time between two consecutive starting times may preferably be more than 100 msec.

Accordingly, a next paper feed job using a newly selected paper feed unit may have no loss time since all the downward moved bottom plates 21 of the unselected paper feed units 200–400 have completed their return operations before the next paper feed job starts. At this time, the return operations are performed with appropriate time differences, such as more than 100 msec, so that the noisy sounds may effectively be reduced.

Figure 5:
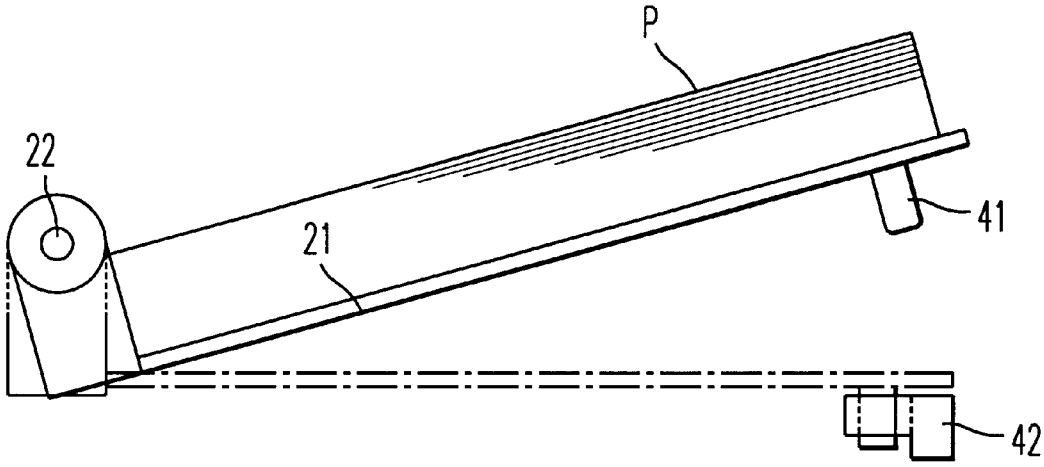
FIG. 5 is an illustration for explaining a downward moving operation of a bottom plate of the sheet elevation mechanism of FIG. 2.

Next, another operation of the above-described downward movement by the bottom plates 21 is explained. An example illustrated in FIG. 5 includes a lowermost position detect mechanism for detecting the bottom plate 21 at a lowermost position of the bottom plate 21. As illustrated in FIG. 5, a feeler 41 is mounted on a front and bottom of each bottom plate 21 and a photo-interrupter 42 is mounted in a corresponding position on each paper cassette or the like. When the bottom plate 21 is moved downward to the lowermost position, the feeler 41 interrupts the photo-interrupter 42, so that the bottom plate 21 is detected at the lowermost position.

In this operation using the lowermost position detect mechanism of FIG. 5, each of the bottom plates 21 of the unselected paper feed units 200–400 is moved downward until the respective photo-interrupter 42 detects the feeler 41 thereof. By performing such an operation, the recording sheets P of each unselected paper cassette 11–13 can be evacuated with a sufficient distance from the feed roller 101, even if the recording sheets P are curled in a relatively strong manner. Thereby, the lowermost position detect mechanism can avoid an occurrence of erroneous transfer of a recording sheet. In addition, the lowermost position detect mechanism can avoid an accidental damage on the paper cassette, which may be caused without the lowermost position detect mechanism when the bottom plate is driven to move downward beyond the lowermost position.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent application Nos. JPAP10-037367 filed on Feb. 19, 1998, and JPAP10-097123 filed on Apr. 9, 1998, the entire contents of which are hereby incorporated by reference.

What is claimed is:

1. A paper feed apparatus, comprising:

a plurality of selectable paper handling mechanisms, each selectable paper handling mechanism including:

a base plate on which recording sheets are stored;

an elevator configured to move said base plate up and down;

a first detector configured to detect whether an uppermost-positioned paper sheet of said recording sheets is positioned at a predetermined paper feed position;

a feed roller configured to rotate in a paper feed direction;

a separation roller configured to contact said feed roller under pressure and be provided with a driving force in a reverse direction relative to said paper feed direction;

a pick-up roller configured to transfer an uppermost-positioned sheet from said recording sheets stored on said base plate to a nip portion formed between said feed roller and said separation roller;

a pushing member configured to push said separation roller to make said separation roller contact said feed roller under pressure when an uppermost-positioned recording sheet is being transferred; and a release member configured to release said separation roller from a condition in which said separation roller is in contact with said feed roller under pressure when no uppermost-positioned recording sheet is being transferred; and a controller configured to control said elevator of a selected paper handling mechanism from among said plurality of paper handling mechanisms to move said recording sheets so that an uppermost-positioned paper sheet of said recording sheets is positioned at said predetermined paper feed position based on a result of detection of said first detector, and controls each elevator other than said elevator of said selected paper handling mechanism to move other respective recording sheets so that an uppermost-positioned paper sheet of said other respective recording sheets is away from said predetermined paper feed position based on a result of detection of said a first detector.

2. A paper feed apparatus of claim 1, wherein each of said plurality of paper handling mechanisms further includes a second detector mounted downstream from said feed roller and said separation roller and which detects whether a transfer of a recording sheet has been completed, and wherein said controller stops operations of said selected paper handling mechanism upon determining that a last recording sheet in a copy job which is charged to said selected paper handling mechanism has been completed by said selected paper handling mechanism based on a result of detection of said second detector of said selected paper handling mechanism.

3. A paper feed apparatus of claim 2, wherein said controller controls each elevator other than said elevator of said selected paper handling mechanism to move said other respective recording sheets so that a respective uppermost-positioned paper sheet of said other respective recording sheets is positioned at said predetermined paper feed position during a time period from a time that said selected paper handling mechanism completes a transfer of said last recording sheet in said copy job until a time that said last recording sheet is ejected.

4. A paper feed apparatus of claim 3, wherein said controller sequentially controls elevators other than said elevator of said selected paper handling mechanism to move said other respective recording sheets with a predetermined time delay from a movement of a previous elevator.

5. A paper feed apparatus of claim 1, wherein each paper handling mechanism further including a third detector configured to detect whether said base plate is positioned at a predetermined lowermost position, and said controller controls each elevator other than said elevator of said selected paper handling mechanism to lower each said other elevator to said predetermined lowermost position based on a result of detection of said third detector.

6. A paper feed apparatus, comprising:

a plurality of selectable paper handling means, each selectable paper handling mechanism including:

base plate means on which recording sheets are stored;

elevator means for moving said base plate means up and down;

first detector means for detecting whether an uppermost-positioned paper sheet of said recording sheets is positioned at a predetermined paper feed position;

feed roller means for rotating in a paper feed direction;

separation roller means in contact with said feed roller means under pressure and provided with a driving force in a reverse direction relative to said paper feed direction;

pick-up roller means for transferring an uppermost-positioned sheet from said recording sheets stored on said base plate means to a nip portion formed between said feed roller means and said separation roller means;

pushing member means for pushing said separation roller means to make said separation roller means contact said feed roller means under pressure when an uppermost-positioned recording sheet is being transferred; and release member means for releasing said separation roller means from a condition in which said separation roller means is in contact with said feed roller means under pressure when no uppermost-positioned recording sheet is being transferred; and controller means for controlling said elevator means of a selected paper handling means from among said plurality of paper handling means to move said recording sheets so that an uppermost-positioned paper sheet of said recording sheets is positioned at said predetermined paper feed position based on a result of detection of said first detector means, and controlling each elevator means other than said elevator means of said selected paper handling means to move other respective recording sheets so that an uppermost-positioned paper sheet of said other respective recording sheets is away from said predetermined paper feed position based on a result of detection of said first detector means.

7. A paper feed apparatus of claim 6, wherein each of said plurality of paper handling means further includes second detector means, mounted downstream from said feed roller means and said separation roller means, for detecting whether transfer of a recording sheet has been completed, and said controller means stops operations of said selected paper handling means upon determining that a last recording sheet in a copy job which is charged to said selected paper handling means has been completed by said selected paper handling means based on a result of detection of said second detector means of said selected paper handling means.

8. A paper feed apparatus of claim 7, wherein said controller means controls each elevator means other than said elevator means of said selected paper handling means to move said other respective recording sheets so that an uppermost-positioned paper sheet of said other respective recording sheets is positioned at said predetermined paper feed position during a time period from a time that said selected paper handling means completes a transfer of said last recording sheet in said copy job until a time that said last recording sheet is ejected.

9. A paper feed apparatus of claim 8, wherein said controller means sequentially controls elevator means other than said elevator means of said selected paper handling means to move said other respective recording sheets with a predetermined time delay from a movement of previous elevator means.

10. A paper feed apparatus of claim 6, wherein each paper handling means further including third detector means which detects whether that said base plate means is positioned at a predetermined lowermost position, and said controller means controls each elevator means other than said elevator means of said selected paper handling means to lower down to said predetermined lowermost position based on a result of detection of said third detector means.

11. A method of paper feeding, comprising the steps of:

storing recording sheets on respective base plates of a plurality of paper handling mechanisms;

moving a respective base plate of a selected paper handling mechanism from among said plurality of paper handling mechanisms;

first detecting whether an uppermost-positioned sheet of said recording sheets on said respective base plate is positioned at a predetermined paper feed position;

transferring said uppermost-positioned sheet to a nip portion formed between a feed roller and a separation roller, said feed roller rotating in a paper feed direction, said separation roller being in contact with said feed roller under pressure and provided with a driving force in a reverse direction relative to said paper feed direction, said separation roller being pushed by a pushing member to make said separation roller contact said feed roller under pressure when said uppermost-positioned recording sheet is being transferred, and said separation roller being released by a release member from a condition in which said separation roller is in contact with said feed roller under pressure when no uppermost-positioned recording sheet is being transferred; and moving downward each base plate other than said base plate of said selected paper handling mechanism so that an uppermost-positioned paper sheet of other respective recording sheets is away from said predetermined paper feed position based on a result of detection of said first detector.

12. A method of claim 11, further comprising the steps of:

second detecting whether transfer of a recording sheet has been completed from said selected paper handling mechanism, said second detecting step being performed downstream from said feed and separation rollers; and stopping said selected paper handling mechanism upon determining that a last recording sheet in a copy job which is charged to said selected paper handling mechanism has been completed from said selected paper handling mechanism based on a result of said second detecting step.

13. A method of claim 12, further comprising the step of restoring by moving each base plate other than said base plate of said selected paper handling mechanism so that an uppermost-positioned paper sheet of said recording sheets placed on said each base plate is positioned at said predetermined paper feed position during a time period from a time that said selected paper handling mechanism completes a transfer of said last recording sheet in said copy job until a time that said last recording sheet is ejected.

14. A paper feed apparatus of claim 13, wherein said restoring step sequentially moves said each base plate other than said base plate of said selected paper handling mechanism with a predetermined time delay from a movement of a previous base plate.

15. A paper feed apparatus of claim 13, further comprising the steps of:

third detecting whether said each base plate is positioned at a predetermined lowermost position; and suspending said restoring step upon detecting whether each base plate other than said each base plate is positioned at a predetermined lowermost position based on a result of said third detecting step.

* * * * *